US010218093B2

(12) United States Patent
Watkins

(10) Patent No.: US 10,218,093 B2
(45) Date of Patent: Feb. 26, 2019

(54) THREAD TO COMPRESS CONNECTOR

(71) Applicant: PPC Broadband, Inc., East Syracuse, NY (US)

(72) Inventor: Harold J. Watkins, Chittenango, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 15/872,940

(22) Filed: Jan. 16, 2018

(65) Prior Publication Data

US 2018/0145432 A1 May 24, 2018

Related U.S. Application Data

(63) Continuation of application No. 15/276,783, filed on Sep. 26, 2016, now Pat. No. 9,871,308, which is a continuation of application No. 14/826,068, filed on Aug. 13, 2015, now Pat. No. 9,455,508.

(60) Provisional application No. 62/036,782, filed on Aug. 13, 2014.

(51) Int. Cl.
*H01R 9/05* (2006.01)

(52) U.S. Cl.
CPC ..... *H01R 9/0518* (2013.01); *H01R 9/0524* (2013.01)

(58) Field of Classification Search
CPC ..... H01R 9/0518; H01R 9/0524; H01R 13/5221; H01B 11/18; H02G 15/04
See application file for complete search history.

(56) References Cited

U.S. PATENT DOCUMENTS

| | | | |
|---|---|---|---|
| 4,150,250 | A | 4/1979 | Lundeberg |
| 4,400,050 | A | 8/1983 | Hayward |
| 4,596,435 | A | 6/1986 | Bickford |
| 4,739,126 | A | 4/1988 | Gutter et al. |
| 4,952,174 | A | 8/1990 | Sucht et al. |
| 4,990,106 | A | 2/1991 | Szegda |
| 5,766,037 | A | 6/1998 | Nelson |
| 5,879,191 | A | 3/1999 | Burris |
| 8,157,589 | B2 | 4/2012 | Krenceski et al. |
| 8,465,322 | B2 | 6/2013 | Purdy |
| 9,130,281 | B2 | 9/2015 | Phillips, Jr. et al. |
| 9,147,955 | B2 | 9/2015 | Hanson et al. |
| 9,166,348 | B2 | 10/2015 | Burris et al. |
| 9,190,744 | B2 | 11/2015 | Burris |
| 9,203,167 | B2 | 12/2015 | Holliday et al. |

(Continued)

FOREIGN PATENT DOCUMENTS

| | | | |
|---|---|---|---|
| CN | 102 664 316 | A | 9/2012 |
| KR | 2010-0096823 | A | 9/2010 |

OTHER PUBLICATIONS

Feb. 13, 2018 Extended European Search Report issued in European Application No. 15831547.3.

(Continued)

*Primary Examiner* — Jean F Duverne
(74) *Attorney, Agent, or Firm* — Oliff PLC

(57) ABSTRACT

A cable connector connects a coaxial cable to an interface port by an outer conductor engager, a body and a coupler. The coupler draws the body over a plurality of resilient fingers of the outer conductor engager to urge the fingers into electrical contact with a peripheral outer surface of a stripped/prepared end of a coaxial cable.

21 Claims, 10 Drawing Sheets

(56) References Cited

U.S. PATENT DOCUMENTS

| | | | | |
|---|---|---|---|---|
| 9,287,659 | B2 | 3/2016 | Burris et al. | |
| 9,633,765 | B2 * | 4/2017 | Natoli | H01B 11/18 |
| 9,819,170 | B2 * | 11/2017 | Natoli | H02G 15/04 |
| 2006/0205272 | A1 | 9/2006 | Rodrigues | |
| 2010/0081321 | A1 | 4/2010 | Malloy et al. | |
| 2010/0235099 | A1 | 9/2010 | Sakai et al. | |
| 2011/0165789 | A1 | 7/2011 | Sykes | |
| 2011/0230089 | A1 | 9/2011 | Amidon et al. | |

OTHER PUBLICATIONS

Nov. 2, 2015 International Search Report and Written Opinion issued in International Application No. PCT/US2015/045136.
Jan. 13, 2017 Office Action issued in U.S. Appl. No. 15/276,783.

* cited by examiner

THREAD TO COMPRESS CONNECTOR

CROSS-REFERENCE TO RELATED APPLICATIONS

This application is a continuation of U.S. application Ser. No. 15/276,783, filed Sep. 26, 2016, pending, which is a continuation of U.S. application Ser. No. 14/826,068, filed on Aug. 13, 2015, now U.S. Pat. No. 9,455,508, which is a non-provisional application that claims the benefits of priority of U.S. provisional application No. 62/036,782, filed on Aug. 13, 2014, the disclosure of which is incorporated herein by reference in its entirety.

BACKGROUND

A coaxial cable is prepared for connection to another cable, or to another RF device, by a coaxial cable connector. Preparation typically requires the use of several specialized tools including a stripping tool and a compression tool. The stripping tool removes a portion of the compliant outer jacket to expose a signal-carrying inner conductor and an outer grounding, or braided, conductor of the cable. The compression tool, on the other hand, inserts a grounding/retention post into the prepared end of the cable to effect an electrical and mechanical connection between the cable and an outer body or housing of the cable connector.

The step of stripping the outer jacket to expose the braided conductor includes a step of folding back the braided conductor upon the end portion of the outer jacket. This step facilitates insertion of the grounding/retention post between the braided conductor and a foil-covered dielectric core of the coaxial cable. While facilitating insertion of the grounding/retention post, this step can be particularly complex and laborious inasmuch as the braided wires of the outer conductor must be individually/collectively lifted from the underlying foil layer and fanned-back over the outer jacket. When lifting the braided wires, the ends thereof can be a source of injury to the installer/preparer. Furthermore, the underlying foil layer can be lifted from the underlying dielectric core and become a source of snagging when the grounding/retention post receives the foil-covered dielectric core.

The step of compressing/inserting the grounding/retention post into the prepared end of the coaxial cable also requires a holding fixture to align the prepared end of the cable while a driver compresses a barbed annular sleeve of the grounding/retention post into/beneath the braided conductor of the cable. As such, the outer jacket may be compressed between the barbed annular sleeve and a fixed-diameter outer housing of the cable connector. Compression of the outer jacket causes the barbed annular sleeve to engage the braided conductor of the cable, thereby retaining the grounding/retention post of the connector to the coaxial cable.

In addition to the cost associated with each preparation step, the stripping and compression tools add undue fiscal burdens, particularly in cost-sensitive markets. That is, the additional cost associated with a particular preparation tool can be the difference between whether a customer selects one connector rather than another. Hence, the requirement for a particular preparation tool, and the fiscal consequences thereof, can be a market discriminator for a manufacturer/producer of coaxial cable connectors.

Accordingly, there is a need to overcome, or otherwise lessen the effects of, the disadvantages and shortcomings described above.

SUMMARY

According to various aspects of the disclosure, a cable connector includes an outer conductor engager configured to receive an end of a coaxial cable. The outer conductor engager has a plurality of resilient fingers configured to be in electrical communication with an outer peripheral surface of an outer conductor of the received coaxial cable, and each resilient finger has a first outward-facing barb and an outward-facing tapered surface. The cable connector includes a body having an annular ring portion coaxially aligned with the outer conductor engager along an axis. The annular ring is configured to circumscribe the coaxial cable and defines an inward-facing lip, a tapered inner surface, and a compression ring. The compression ring is disposed at an opposite axial side of the tapered inner surface relative to the inward-facing lip, and the inward-facing lip of the body engages the first outward-facing barb of each resilient finger when the body is disposed in a first axial position in a pre-installed state. The cable connector also includes a coupler rotatably mounted relative to the annular ring of the body. The coupler is operative to move the body axially relative to the outer conductor engager such that the tapered inner surface of the body engages the tapered outer surface of the outer conductor engager, and the compression ring of the body urges the tapered outer surface of each resilient finger against the peripheral outer surface of the outer conductor when the body is moved axially relative to the outer conductor engager by the coupler to a second axial position in an installed state.

In accordance with some aspects of the disclosure, a method of installing a connector includes providing a connector, inserting an end of a coaxial cable into an outer conductor engager, and fastening the coupler to an interface port. The connector includes an outer conductor engager having a plurality of resilient fingers in electrical communication with an outer peripheral surface of an outer conductor of the coaxial cable. Each resilient finger has a first outward-facing barb and an outward-facing tapered surface. A body of the connector includes an annular ring portion coaxially aligned with the outer conductor engager along an axis, the annular ring portion defining an inward-facing lip, a tapered inner surface, and a compression ring. The compression ring is disposed at an opposite axial side of the tapered inner surface relative to the inward-facing lip, and the inward-facing lip of the body engages the first outward-facing barb of each resilient finger when the body is disposed in a first axial position in a pre-installed state. A coupler is rotatably mounted relative to the annular ring of the body. Inserting the end of the coaxial cable into the outer conductor engager places a plurality of resilient fingers of the outer conductor engager in electrical communication with an outer peripheral surface of the outer conductor of the coaxial cable, and the body circumscribes the coaxial cable. Fastening the coupler to an interface port causes the body to move axially relative to the outer conductor engager such that the tapered inner surface of the body engages the tapered outer surface of the outer conductor engager. When the body is moved axially relative to the outer conductor engager, the compression ring of the body urges the tapered outer surface of each resilient finger against the peripheral outer surface of the outer conductor to a second axial position in an installed state.

In some aspects, a cable connector includes an outer conductor engager, a body, and a coupler. The outer conductor engager is configured to receive an end of a coaxial cable. The outer conductor engager has a plurality of resilient fingers configured to be in electrical communication with an outer peripheral surface of an outer conductor of the received coaxial cable, and each resilient finger has a first outward-facing barb, a second outward-facing bard, and an outward-facing tapered surface. The outward-facing tapered surface is at an opposite side of the first outward-facing barb relative to the second outward-facing barb. The body includes an annular ring portion coaxially aligned with the outer conductor engager along an axis. The annular ring is configured to circumscribe the coaxial cable and defines an inward-facing lip, a tapered inner surface, and a compression ring. The compression ring is disposed at an opposite axial side of the tapered inner surface relative to the inward-facing lip, and the inward-facing lip of the body engages the first outward-facing barb of each resilient finger when the body is disposed in a first axial position in a pre-installed state. The coupler is rotatably mounted relative to the annular ring of the body. When the coupler is threadably fastened to an interface port, the coupler is operative to move the body axially relative to the outer conductor engager such that the tapered inner surface of the body engages the tapered outer surface of the outer conductor engager and the received coaxial cable moves with the outer conductor engager relative to the body. The compression ring of the body is configured to urge the tapered outer surface of each resilient finger against the peripheral outer surface of the outer conductor when the body is moved axially relative to the outer conductor engager by the coupler to a second axial position in an installed state. The inward-facing lip of the body engages the second outward-facing barb of each resilient finger when the body is disposed in a second axial position in the installed state.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
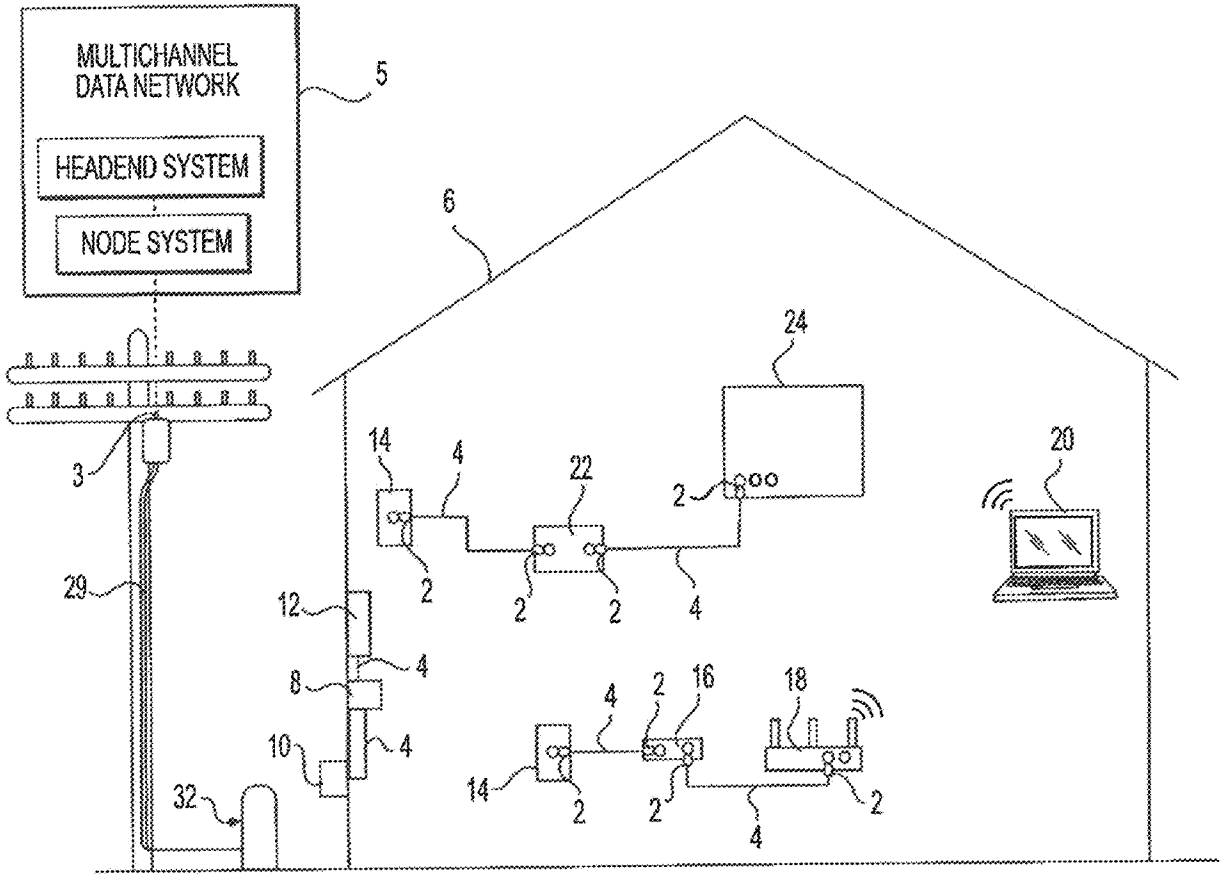
FIG. 1 is a schematic view of an exemplary network environment in accordance with various aspects of the disclosure.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In some embodiments, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol ("VoIP") phone service, Internet Protocol TV ("IPTV") data streams, multimedia content, audio data, music, radio and other types of data.

In some embodiments, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range of 1125 MHz to 1675 MHz. MoCA compatible devices can form a private network inside the environment 6.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
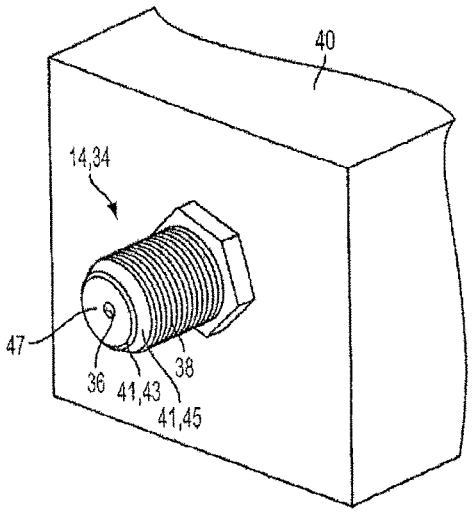
FIG. 2 is a perspective view of an exemplary interface port in accordance with various aspects of the disclosure.

In one embodiment, each of the female interface ports 14 includes a stud or jack, such as the cylindrical stud 34 illustrated in FIG. 2. The stud 34 has: (a) an inner, cylindrical wall 36 defining a central hole configured to receive an electrical contact, wire, pin, conductor (not shown) positioned within the central hole; (b) a conductive, threaded outer surface 38; (c) a conical conductive region 41 having conductive contact sections 43 and 45; and (d) a dielectric or insulation material 47.

In some embodiments, stud 34 is shaped and sized to be compatible with the F-type coaxial connection standard. It should be understood that, depending upon the embodiment, stud 34 could have a smooth outer surface. The stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34. Once installed, the connector 2 receives the female interface port 34. The connector 2 establishes an electrical connection between the cable 4 and the electrical contact of the female interface port 34.

Figure 4:
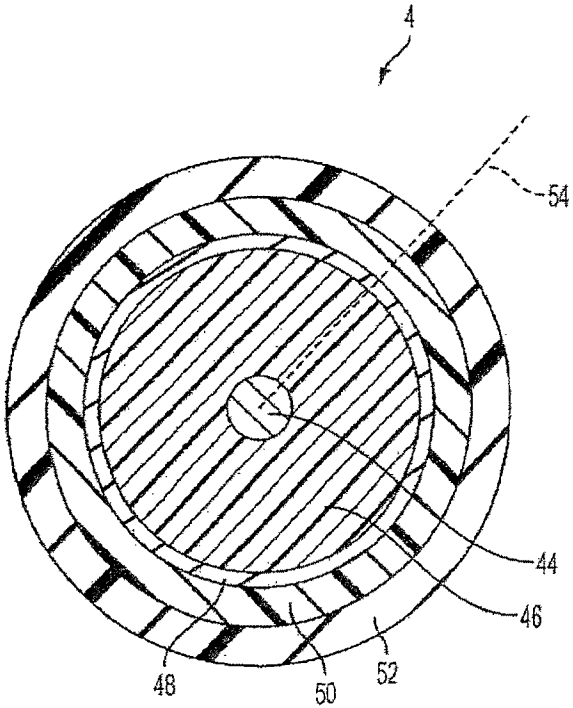
FIG. 4 is a cross-sectional view of the exemplary coaxial cable of FIG. 3.
Figure 3:
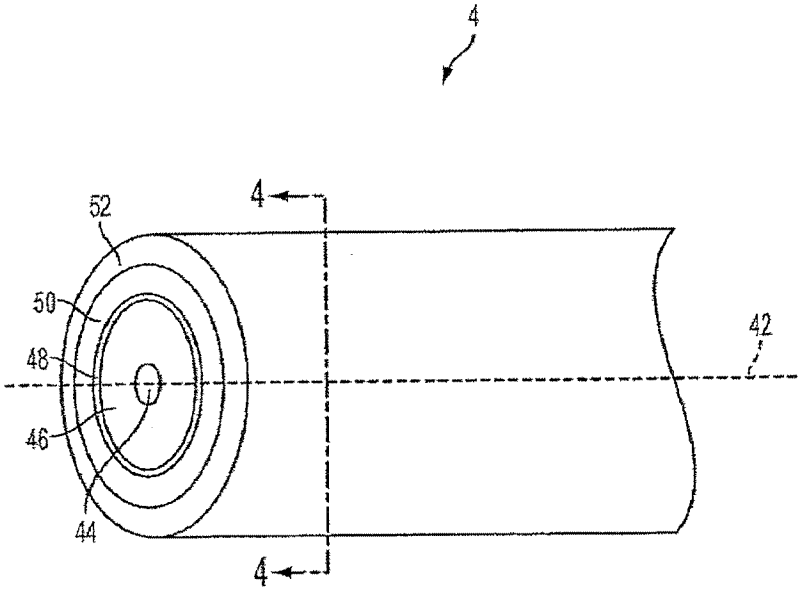
FIG. 3 is a perspective view of an exemplary coaxial cable in accordance with various aspects of the disclosure.
Figure 5:
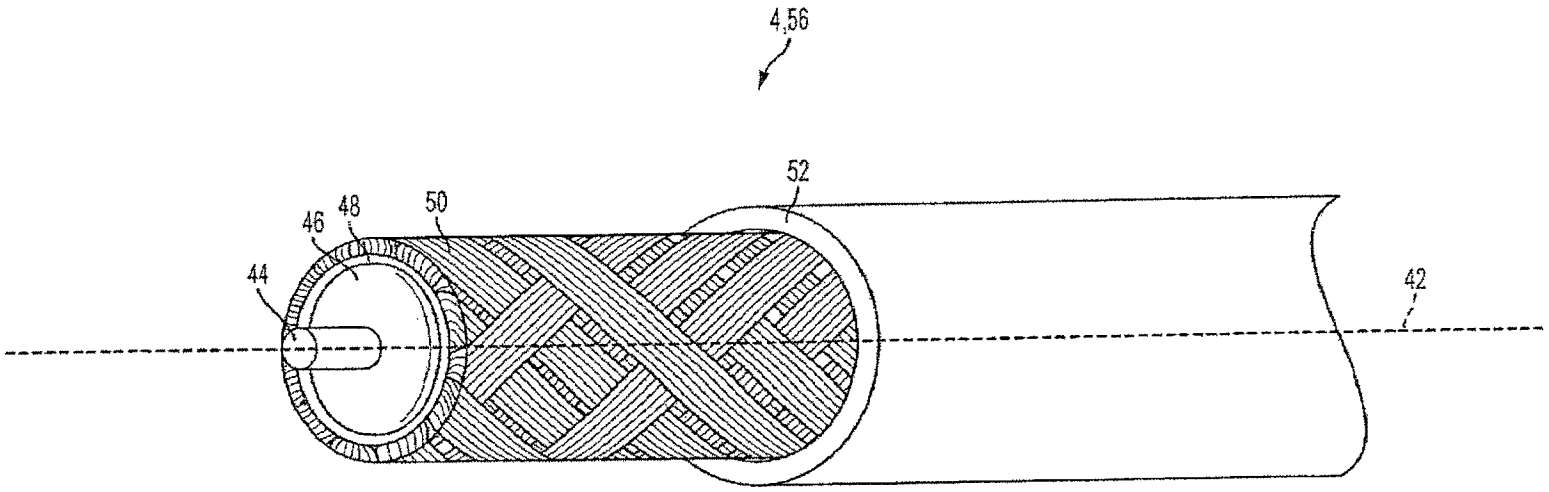
FIG. 5 is a perspective view of an exemplary prepared end of the exemplary coaxial cable of FIG. 3.

Referring to FIGS. 3-5, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in some embodiments, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, the connector 2 electrically grounds the outer conductor 50 of the coaxial cable 4. The conductive foil layer 48, in one embodiment, is an additional, tubular conductor which provides additional shielding of the magnetic fields. In one embodiment, the jacket 52 has a protective characteristic, guarding the cable's internal components from damage. The jacket 52 also has an electrical insulation characteristic.

Referring to FIG. 5, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a two step-shaped configuration. In some embodiments, the prepared end has a three step-shaped configuration (not shown), where the insulator 46 extends beyond an end of the foil 48 and outer conductor 50. At this point, the cable 4 is ready to be connected to the connector 2.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 6:
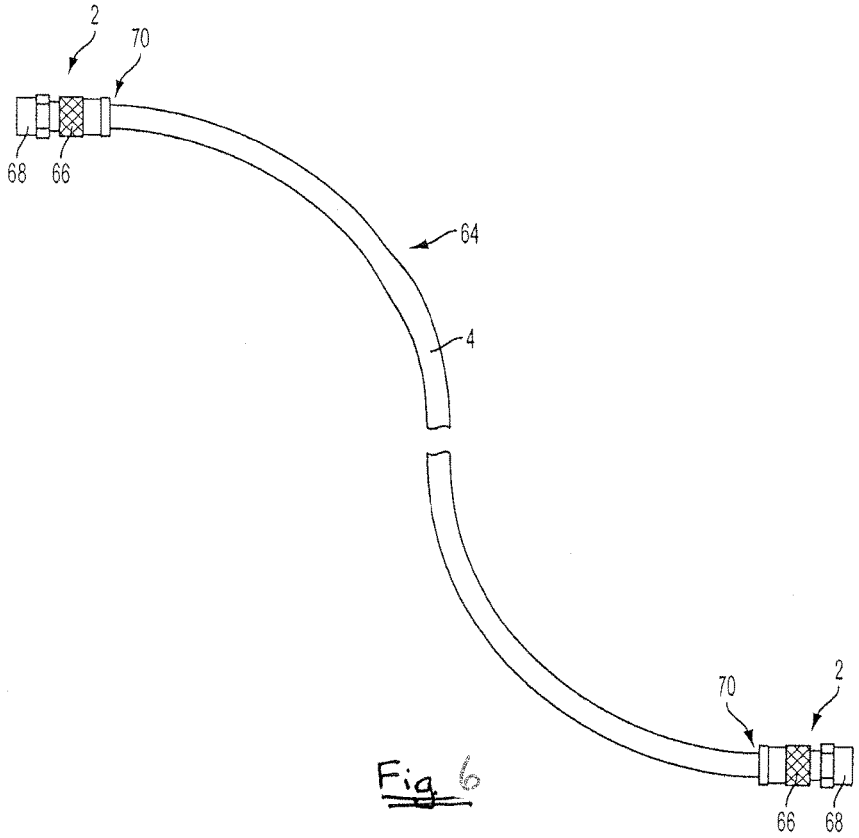
FIG. 6 is a top view of one embodiment of a coaxial cable jumper or cable assembly which is configured to be operatively coupled to the multichannel data network.
Figure 7:
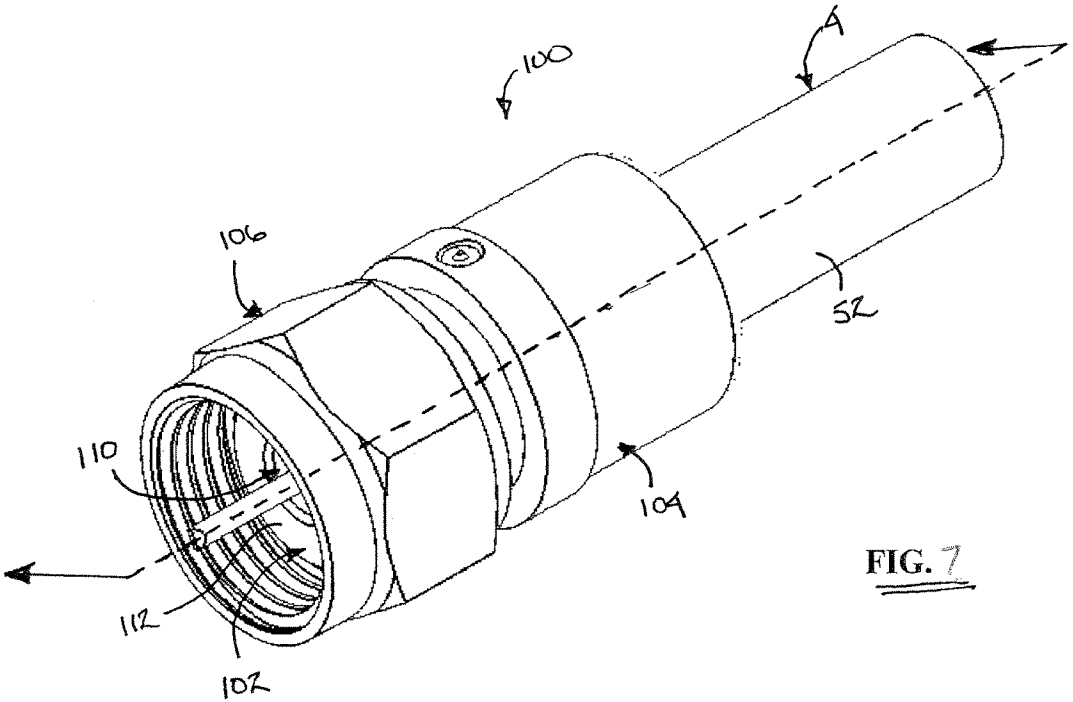
FIG. 7 is an isometric view of an exemplary thread to compress connector disposed in combination with a coaxial cable.
Figure 8:
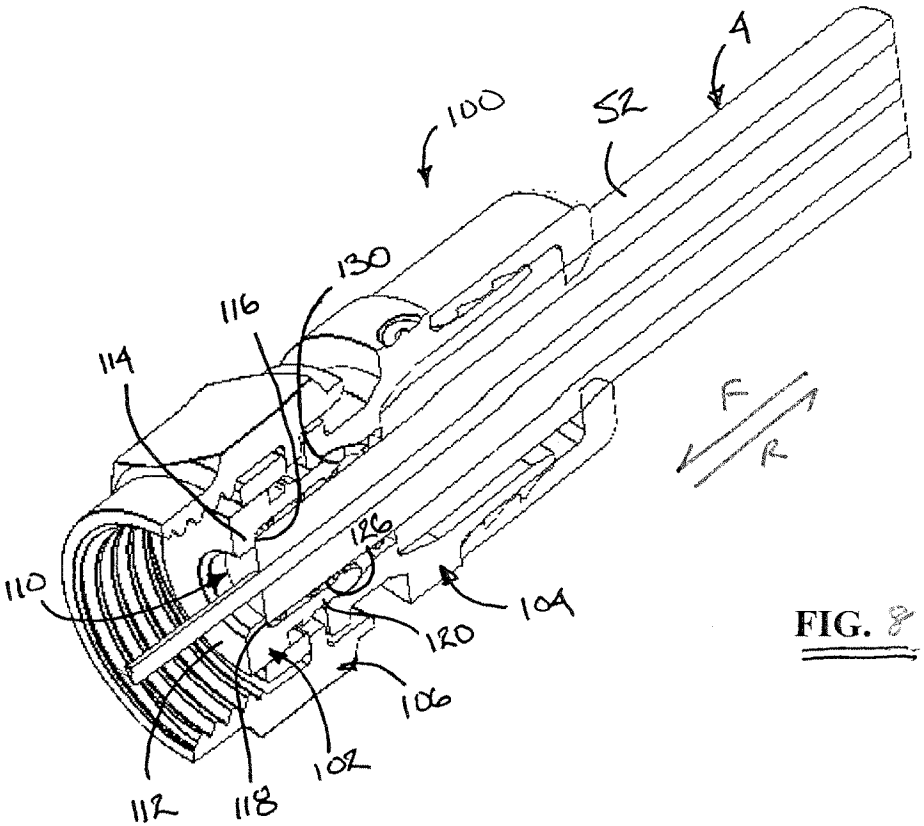
FIG. 8 is a cross-sectional view taken substantially along line 8-8 of FIG. 7.
Figures 9, 10:
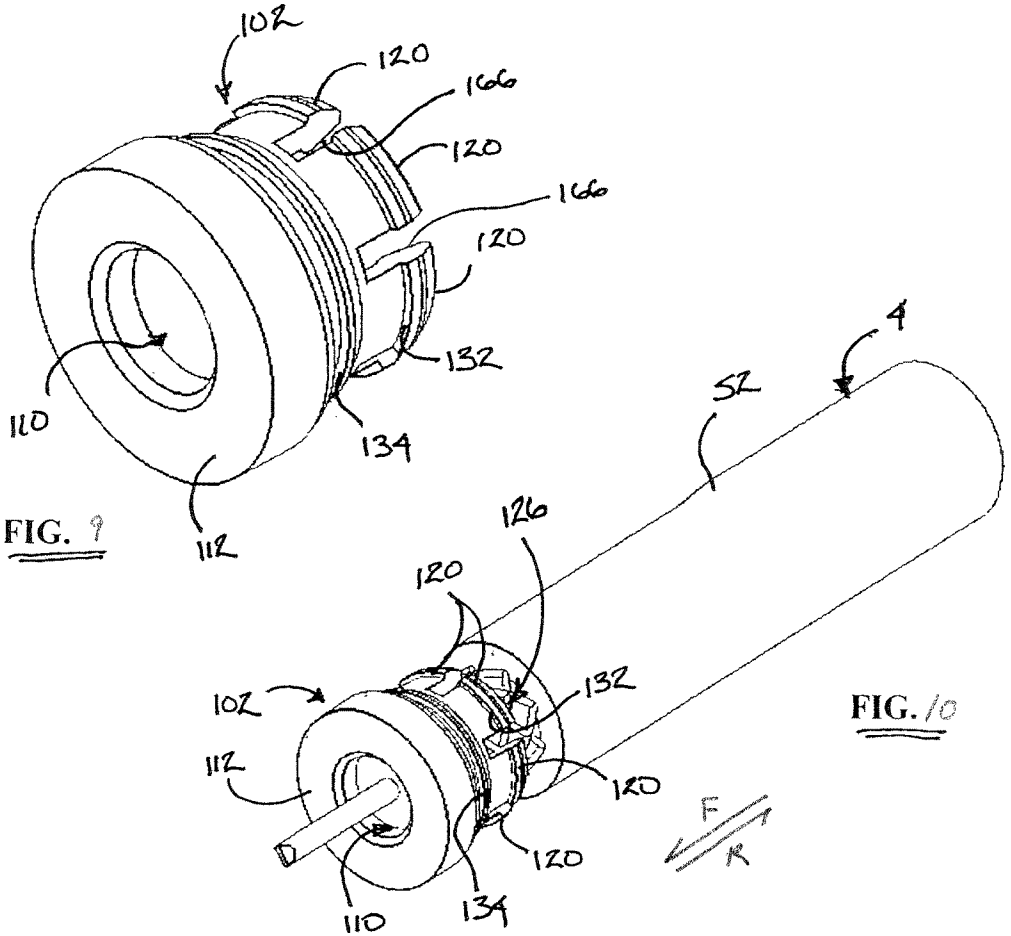
FIG. 9 is an isolated, isometric view of the outer conductor engager including a plurality of resilient fingers projecting axially away from an interface port in a rearward direction.
FIG. 10 is an isometric view of the outer conductor engager of the connector of FIG. 7 disposed in combination with a prepared end of a coaxial cable.

In one embodiment illustrated in FIG. 6, a cable jumper or cable assembly 64 includes a combination of the connector 2 and the cable 4 attached to the connector 2. In this embodiment, the connector 2 includes a connector body or connector housing 66 and a fastener or coupler 68, such as a threaded nut, which is rotatably coupled to the connector housing 66. The cable assembly 64 has, in one embodiment, connectors 2 on both of its ends 70. In some embodiments, the cable assembly 64 may have a connector 2 on one end and either no connector or a different connector at the other end. Preassembled cable jumpers or cable assemblies 64 can facilitate the installation of cables 4 for various purposes.

The cable connector of the present disclosure provides a reliable electrical ground, a secure axial connection and a watertight seal across leakage-prone interfaces of the coaxial cable connector.

The cable connector comprises an outer conductor engager or post, a housing or body, and a coupler or threaded nut to engage an interface port. The outer conductor engager includes an aperture for receiving the outer braided conductor of a prepared coaxial cable, i.e., an end which has been stripped of its outer jacket similar to that shown in FIG. 5, and a plurality of resilient fingers projecting axially away from the interface port. The body receives and engages the resilient fingers of the outer conductor engage to align the body with the outer conductor engager in a pre-installed state.

During installation, the body is bearing-mounted to the coupler and translates axially relative to the outer conductor engager as the coupler engages the interface port. The body is configured such that axial translation effects radial displacement of the resilient fingers against an outer peripheral surface of the braided conductor. In an installed state, the resilient fingers effect a reliable electrical ground from the outer conductor to the interface port through the outer conductor engager. Furthermore, the resilient fingers effect a secure mechanical connection between the coaxial cable and the connector as a barbed edge of each resilient finger retards the axial motion of the coaxial cable relative to the outer conductor engager. Finally, a watertight seal is produced at the mating interfaces between the outer conductor engager, the body, and the coupler. More specifically, the body and the coupler produce watertight seals with the outer conductor engager as each moves from a partially-installed state to a fully-installed state.

According to the disclosure, the aforementioned connectors 2 may be configured as coaxial cable connector 100, as illustrated in FIGS. 7-12. For the purposes of establishing a directional frame of reference, the forward and rearward directions relative to the connector 100 are given by arrows F and R, respectively, in FIGS. 8 and 10-12. When the connector 100 is installed on an interface port 14, a forward end, portion, or direction is proximal to, or toward, the interface port 14, and a rearward end, portion, or direction is distal, or away, from the interface port 14.

For purposes of this disclosure, with reference to the connector 100, a pre-installed or uninstalled state or configuration refers to the connector 100 before it is coupled with the coaxial cable 4 and the interface port 14. A partially-installed state refers to the connector 100 when it is coupled with the coaxial cable 4, but not with the interface port 14. An installed or fully-installed state refers to the connector 100 when it is coupled with the coaxial cable 4 and the interface port 14.

Referring now to FIGS. 7-12, the coaxial cable connector 100 includes an outer conductor engager or post 102, a body or housing 104, and a threaded coupler 106. The outer conductor engager 102 includes a radially-inward projecting flange 114 having a forward-facing front face surface 112 for electrically engaging a face surface of an interface port 14 (described in more detail below). The flange 114 also defines a rearward-facing stop surface 116 for engaging an edge 118 of a coaxial cable 4. The outer conductor engager 102 defines an aperture 110 for accepting a portion of the coaxial cable 4. The connector 100 also includes a sealing member 190, for example, a ring-shaped seal, extending around an outer periphery of the flange 114 and being disposed within the threaded coupler 106.

The outer conductor engager 102 includes a plurality of resilient fingers 120 for engaging a peripheral outer surface 126 of the braided outer conductor 50 of the coaxial cable 4. In the described embodiment, each resilient finger 120 includes an inward-facing barb 130 and a first outward-facing barb 132 at the rearward end of the outer conductor engager 102, i.e., the end which is distal, or away, from the front face surface 112 of the outer conductor engager 102. Each resilient finger 120 also includes an outward-facing tapered surface 136 disposed rearward of the first outward-facing barb 132 and a second outward-facing barb 134 disposed forward of the first outward-facing barb 132.

In the described embodiment, the inward-facing barbs 130 are structured and arranged to electrically engage the outer or external peripheral surface 126 of the braided conductor 50 of the coaxial cable 4 in the partially-installed and fully-installed states. Alternatively, if the braid is folded back, as required by a conventional connector, the inward facing barbs 130 can also make contact with the foil. The inward-facing barbs 130 also facilitate electrical grounding and retention of the coaxial cable 4 when a radial load displaces a resilient finger 120 against the braided outer conductor 50 of the coaxial cable 4, for example, in the installed state, as discussed in more detail below. It should be appreciated that in alternative embodiments, a radial bore in the outer conductor engager 102 can replace the barbs 130. In such an alternative embodiment, the bore is configured to close radially to electrically engage the outer conductor 50.

The body 104 includes a conductive annular fitting 140 defining an aperture 144 for receiving a portion of the coaxial cable 4. The annular fitting 140 includes a forward annular ring portion 146 configured to rotatably engage the threaded coupler 106 and a rearward annular ring portion 148 configured to engage a weather protecting boot 150. The forward annular ring portion 146 includes a bi-directional flange having a first inward-facing lip 152 and an outward-facing lip 154. The forward annular ring portion 146 also includes a compression ring 160 disposed rearward of the bi-directional flange and a tapered inner surface 164 extending rearward from the bi-directional flange to the compression ring 160. In the pre-installed and partially-installed states, the tapered inner surface 164 is disposed in axial and radial proximity with the outward-facing tapered surfaces 136 of the resilient fingers 120. In some aspects, the resilient fingers 120 may not be radially deflected in the pre-installed and partially-installed states by the relative positioning between the tapered inner surface 164 and the outward-facing tapered surfaces 136. In other aspects, the resilient fingers 120 may be radially deflected in the pre-installed and partially-installed states by the relative positioning between the tapered inner surface 164 and the outward-facing tapered surfaces 136.

The rearward annular ring 148 of the body 104 includes a second inward-facing annular lip 168 configured to engage a forward stop surface 170 along the outer jacket 52 of the coaxial cable 4. Furthermore, the rearward annular ring 148 includes a pair of outward-facing barbs 172 (see, e.g, FIGS. 11 and 12) for engaging the weather protecting boot 150 to form a watertight seal against the outer surface of the compliant outer jacket 52 of the coaxial cable 4.

Figure 11:
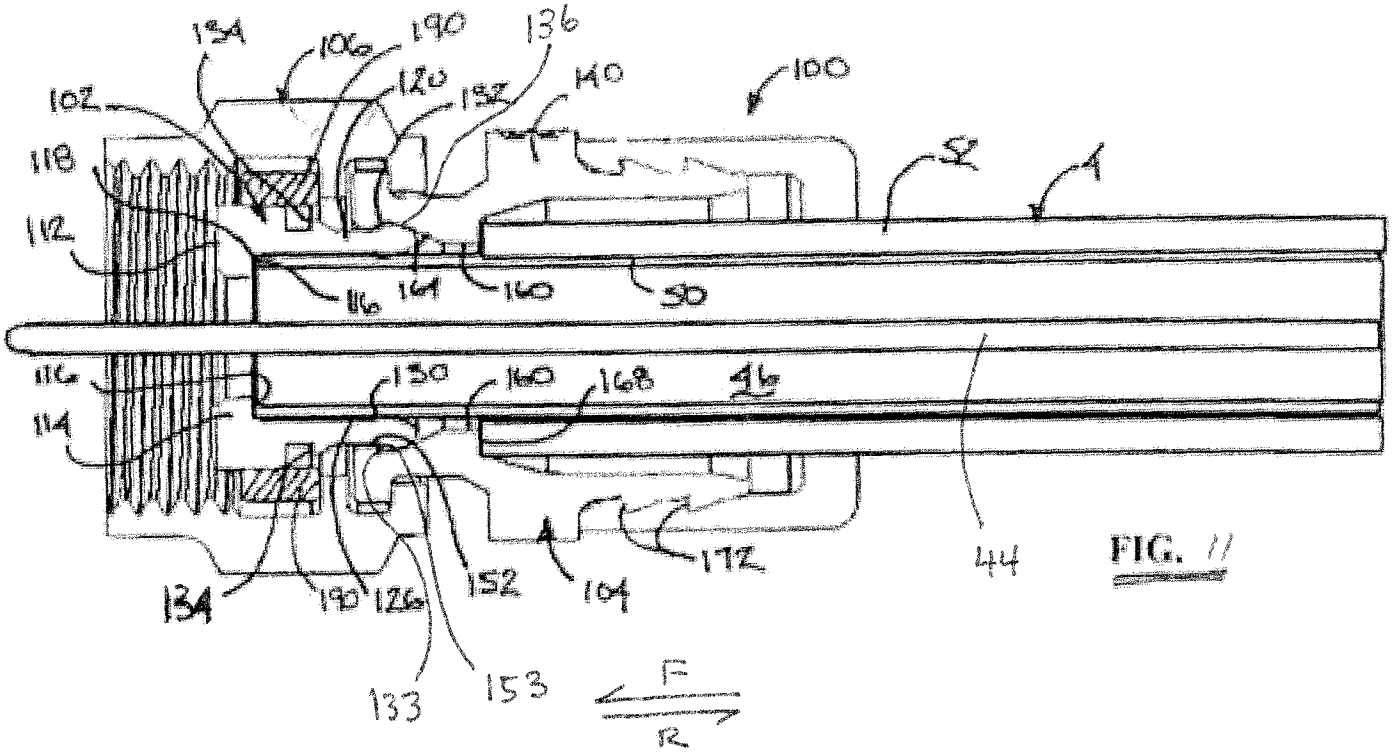
FIG. 11 is a cross-sectional view of the cable connector of FIG. 7 in a partially-installed state.
Figure 12:
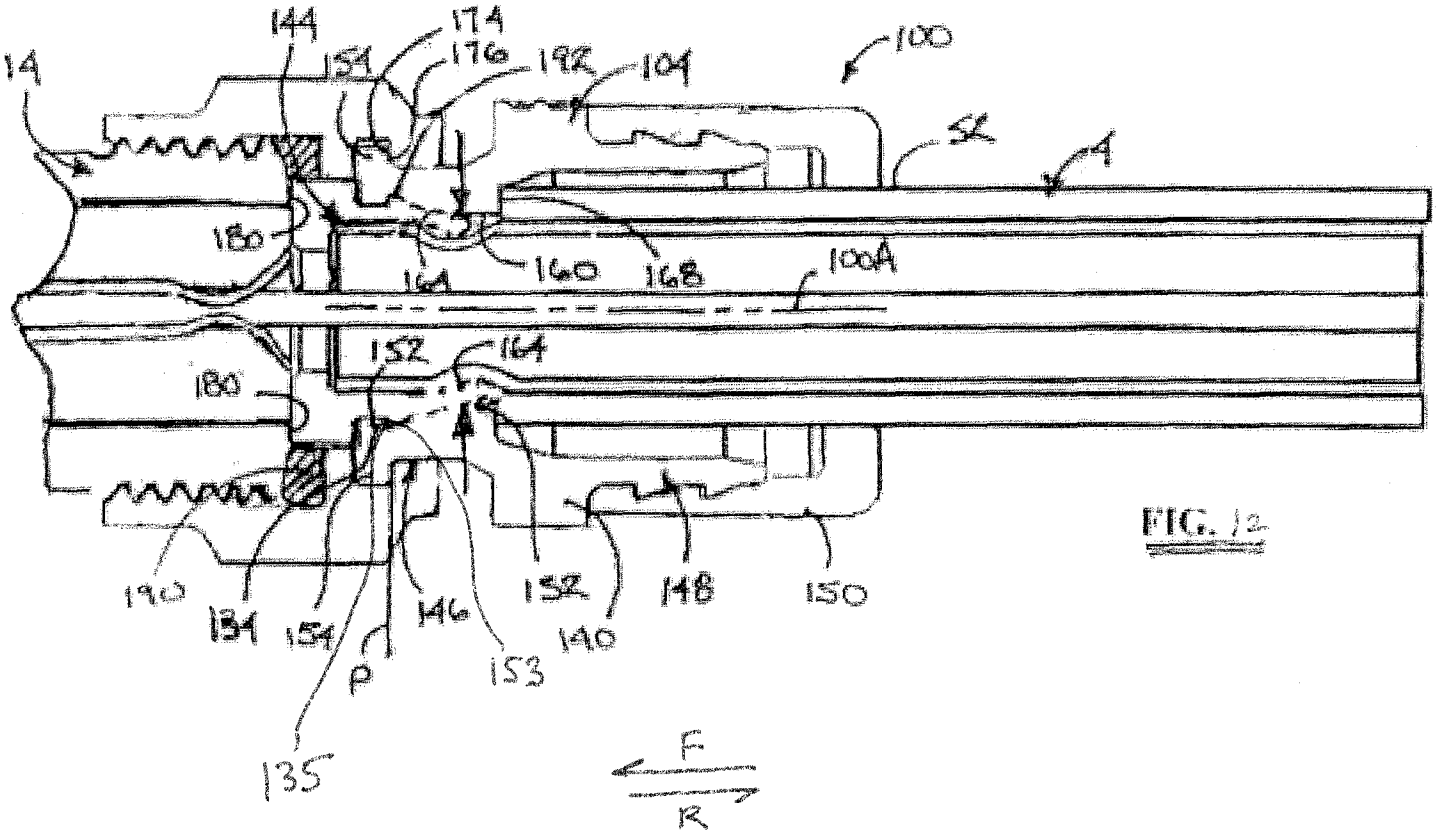
FIG. 12 is a cross-sectional view of the cable connector of FIG. 7 in a fully-installed state.

The threaded coupler 106 includes a threaded portion 107 at its forward end for threadably engaging the threaded outer surface 38 of the interface port 14. A rearward end of the threaded coupler 106 is bearing-mounted to the forward annular ring 146 of the body 104 such that the coupler 106 is rotatable relative to the body 104. Referring to FIGS. 11 and 12, the threaded coupler 106 includes a bearing surface 176 that engages a bearing surface 174 of the body 104. The bearing surfaces 174, 176 are aligned along a plane P, orthogonal to an elongate axis 100A of the cable connector 100.

As shown in FIG. 11, when the connector is in the pre-installed and partially-installed states, the first inward-facing lip 152 of the body 104 is between the first and second outward-facing barbs 132, 134 of each resilient finger 120. The first inward-facing lip 152 includes a rearward-facing surface 153 that engages forward-facing surfaces 133 of the first outward-facing barbs 132 of each resilient finger 120 to align the outer conductor engager 102 with the body 104 in the pre-installed and partially-installed states. This structural connection maintains alignment of the body 104 relative to the outer conductor engager 102 during shipment and handling of the cable connector 100. The second outward-facing barbs 134 of each resilient finger 120 also include forward-facing surfaces 135, as will be discussed in more detail below.

In the partially-installed state, the coaxial cable 4 is inserted into the connector 100. For example, the inner conductor 44, the insulator 46, and the outer conductor 50 are inserted through the aperture 144 of the body 104 and into the aperture 110 of the outer conductor engager 102. Particularly, the coaxial cable 4 is inserted into the connector 100 until the forward stop surface 170 along the outer jacket 52 of the coaxial cable 4 abuts a rearward-facing stop surface of the second inward-facing annular lip 168 of the body 104 and the forward edge surface 118 of the insulator 46 and outer conductor 50 abut the rearward-facing stop surface 116 of the outer conductor engager 102. The inner conductor 44 extends through the apertures 110, 144 and extends beyond the front face surface 112 of the outer conductor engager 102.

During installation of the connector 100 to an interface port 14, the coupler 106 threadably engages the interface port 14. As the coupler 106 is fastened to the interface port 14, for example, by rotating the coupler 106 relative to the interface port 14, the interface port 14 is drawn toward the outer conductor engager 102 such that a face surface 180 of the interface port 14 engages the front face surface 112 of the outer conductor engager 102. As the threaded coupler 106 is further fastened to the interface port 14, for example, by further relative rotation, the interface port 14 forces the outer conductor engager 102 axially into the forward annular ring 146 of the body 104. Additionally, because of the abutting relationship between the forward edge surface 118 of the insulator 46 and outer conductor 50 abut the rearward-facing stop surface 116 of the outer conductor engager 102, as the outer conductor engager 102 is moved rearward relative to the body 104, the forward edge surface 118 of the coaxial cable 4 is also moved rearward relative to the body 104. As a result, the forward stop surface 170 along the outer jacket 52 of the coaxial cable 4 moves rearward with the outer conductor engager 102 out of abutment with the rearward-facing stop surface of the second inward-facing annular lip 168 of the body 104.

More specifically, as the threaded coupler 106 is further fastened to the interface port 14, relative axial motion between the body 104 and the outer conductor engager 102 causes the tapered outer surface 136 of the outer conductor engager 102 to engage a tapered inner surface 164 of the body 104. As the fastening continues, the resilient fingers 120 are urged radially inward, or compressed, against the braided outer conductor 50 of the coaxial cable 4 as the outer conductor engager 102 continues to move axially relative to the outer body 104. Radial displacement of the resilient fingers 120 urges the inward-facing barbs 130 of each of the resilient fingers 120 against the braided outer conductor 50 of the coaxial cable 4.

Further rotation of the coupler 106 causes the inward-facing barbed edge 130 to become axially aligned with the compression ring surface 160 along the axis 100A and causes the second outward-facing barb 134 of the outer conductor engager 102 to move rearward relative to the inward-facing lip 152 along axis 100A. Furthermore, when the coupler 106 is fully tightened against the interface port 14, the outer conductor engager 102 is disposed rearward relative to the inward-facing lip 152 along the axis. Thus, in the fully installed state of the connector 100, the forward-facing surface 135 of the second outward-facing barbed edge 134 of the outer conductor engager 102 engages the rearward-facing surface 153 of the inward-facing lip 152 of the body 104, and the body 104 is axially retained by the barbed edge 134 of the outer conductor engager 102. Additionally, in the fully installed state, the forward edge surface 118 of the insulator 46 and outer conductor 50 abut the rearward-facing stop surface 116 of the outer conductor engager 102, while the forward stop surface 170 along the outer jacket 52 of the coaxial cable 4 is spaced rearward from the rearward-facing stop surface of the second inward-facing annular lip 168 of the body 104.

In addition to providing an electrical ground and mechanical connection against the peripheral external surface 126 of the braided outer conductor 50 in the installed state, the coaxial cable connector 100 provides a plurality of watertight seals across interfaces between the outer conductor engager 102, the body 104, and the threaded coupler 106. For example, as the interface port 14 engages the front face of the outer conductor engager 102, a/ portion of the face surface 180 deforms the ring-shaped seal 190 such that seals are formed at the interfaces of the interface port 14, the outer conductor engager 102, and the threaded coupler 106. Additionally, as the rearward-facing surface 153 of the inward-facing lip 152 engages the forward-facing surface 135 of second outward-facing barbed edge 134, a seal is formed between the outer conductor engager 102 and the body 104. Another seal is formed between the rearward annular ring 148, the weather protecting boot 150, and the outer jacket 52 of the coaxial cable 4, as the barbs of the annular ring create pressure points that provide a seal between the body 104 and the boot 150, and the boot 150 has an opening sized slightly smaller relative to the outer jacket 52 to provide a seal.

The embodiment of the present disclosure provides an apparatus and method for producing a reliable electrical ground, a secure mechanical connection, and a plurality of watertight seals to protect a coaxial cable connector. The apparatus and method eliminates the need to fold the outer conductor over the compliant outer jacket 52 of the coaxial cable 4. Furthermore the apparatus and method employs the interface port 14 as the device for compressing the outer conductor engager 102 into the body 104. As a consequence, the apparatus and method eliminates the requirement for a compression tool.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A cable connector, comprising:

an outer conductor engager configured to receive an end of a coaxial cable and to be in electrical communication with an outer conductor of the received coaxial cable;

a body configured to circumscribe the received coaxial cable;

a coupler configured to move the body axially relative to the outer conductor engager such that a tapered inner surface of the body engages the outer conductor engager; and a compression ring disposed rearward of the tapered inner surface along an axial direction, wherein the compression ring is configured to urge the outer conductor engager against the outer conductor when the body is moved axially relative to the outer conductor engager by the coupler.

2. The cable connector of claim 1, wherein the body includes an annular ring portion defining an inward-facing lip, the tapered inner surface, and the compression ring.

3. The cable connector of claim 2, wherein the outer conductor engager includes a plurality of resilient fingers configured to be in electrical communication with the outer conductor of the received coaxial cable, each resilient finger having a first outward-facing barb and an outward-facing tapered surface, and wherein the inward-facing lip of the body is configured to engage the first outward-facing barb of each resilient finger before the body is moved axially relative to the outer conductor engager by the coupler.

4. The cable connector of claim 1, wherein the coupler includes a threaded portion configured to be threadedly engaged with the interface port and to be fastened to the interface port by relative rotation, the interface port being configured to be drawn toward the outer conductor engager by the fastening such that a face surface of the interface port is configured to engage a front face surface of the outer conductor engager.

5. The cable connector of claim 4, wherein the outer conductor engager has an outer surface that tapers rearwardly along the axial direction, and wherein, after the interface port engages a front face surface of the outer conductor engager, the interface port is configured to force the outer conductor engager axially relative to the body when further fastened, thereby causing the tapered inner surface of the body to engage the tapered outer surface of the outer conductor engager.

6. The cable connector of claim 2, wherein the body includes a second inward-facing annular lip having a rearward-facing stop surface configured to abutingly receive a forward stop surface along an outer jacket of the received coaxial cable, wherein the outer conductor engager includes a rearward-facing stop surface configured to abutingly receive a forward edge surface of the outer conductor and an insulator of the received coaxial cable, and wherein the forward edge surface of the coaxial cable is configured to be moved rearward with the outer conductor engager relative to the body as the outer conductor engager is moved relative to the body.

7. The cable connector of claim 6, wherein the forward stop surface along the outer jacket of the coaxial cable is configured to move rearward with the outer conductor engager out of abutment with the rearward-facing stop surface of the second inward-facing annular lip of the body, wherein the outer conductor engager includes a second outward-facing barb having a forward-facing surface, the second outward-facing barb being at an opposite axial side of the first outward-facing barb relative to the tapered outer surface of the outer conductor engager, wherein the forward-facing surface of the second outward-facing barb is configured to engage a rearward-facing surface of the inward-facing lip of the body when the coupler is fully tightened against the interface port, and wherein the body is configured to be axially retained by the second barb of the outer conductor engager in a fully installed state of the connector.

8. A cable connector, comprising:

an outer conductor engager configured to receive an end of a coaxial cable and to be in electrical communication with an outer conductor of the received coaxial cable;

a body configured to circumscribe the coaxial cable and to engage the outer conductor engager when the body is disposed in a first axial position;

a coupler configured to move the body axially relative to the outer conductor engager such that an inner surface of the body engages the outer conductor engager; and a compression ring disposed rearward of a forward end of the body along an axial direction, the compression ring being configured to have an inner surface having a diameter that is smaller than a diameter of an inner surface of the forward end of the body, wherein the compression ring is configured to urge the outer conductor engager against the outer conductor when the body is moved axially relative to the outer conductor engager by the coupler to a second axial position.

9. The cable connector of claim 8, wherein the body includes an annular ring portion defining an inward-facing lip at the forward end of the body, a tapered inner surface, and the compression ring.

10. The cable connector of claim 9, wherein the outer conductor engager includes a plurality of resilient fingers configured to be in electrical communication with the outer conductor of the received coaxial cable, each resilient finger having a first outward-facing barb and an outward-facing tapered surface, and wherein the inward-facing lip of the body is configured to engage the first outward-facing barb of each resilient finger when the body is disposed in the first axial position.

11. The cable connector of claim 9, wherein the coupler includes a threaded portion configured to be threadedly engaged with the interface port and to be fastened to the interface port by relative rotation, the interface port being configured to be drawn toward the outer conductor engager by the fastening such that a face surface of the interface port is configured to engage a front face surface of the outer conductor engager.

12. The cable connector of claim 11, wherein the outer conductor engager has an outer surface that tapers rearwardly along the axial direction, and wherein, after the interface port engages a front face surface of the outer conductor engager, the interface port is configured to force the outer conductor engager axially relative to the body when further fastened, thereby causing the tapered inner surface of the body to engage the tapered outer surface of the outer conductor engager.

13. The cable connector of claim 9, wherein the body includes a second inward-facing annular lip having a rearward-facing stop surface configured to abutingly receive a forward stop surface along an outer jacket of the received coaxial cable, wherein the outer conductor engager includes a rearward-facing stop surface configured to abutingly receive a forward edge surface of the outer conductor and an insulator of the received coaxial cable, and wherein the forward edge surface of the coaxial cable is configured to be moved rearward with the outer conductor engager relative to the body as the outer conductor engager is moved relative to the body.

14. The cable connector of claim 13, wherein the outer conductor engager has an outer surface that tapers rearwardly along the axial direction, wherein the forward stop surface along the outer jacket of the coaxial cable is configured to move rearward with the outer conductor engager out of abutment with the rearward-facing stop surface of the second inward-facing annular lip of the body, wherein the outer conductor engager includes a second outward-facing barb having a forward-facing surface, the second outward-facing barb being at an opposite axial side of the first outward-facing barb relative to the tapered outer surface of the outer conductor engager, wherein, the forward-facing surface of the second outward-facing barb is configured to engage a rearward-facing surface of the inward-facing lip of the body when the coupler is fully tightened against the interface port, and wherein the body is configured to be axially retained by the second barb of the outer conductor engager in a fully installed state of the connector.

15. A cable connector, comprising an outer conductor engager having an outer surface that tapers rearwardly along an axial direction, the outer conductor engager being configured to receive an end of a coaxial cable and to be in electrical communication with an outer conductor of the received coaxial cable;

a body configured to circumscribe the coaxial cable, the body being configured to engage the outer conductor engager when the body is disposed in a first axial position;

a coupler configured to move the body axially relative to the outer conductor engager such that a surface of the body engages the tapered outer surface of the outer conductor engager; and a compression ring disposed rearward of a forward end of the body along the axis, the compression ring being configured to have an inner surface having a diameter that is smaller than a largest diameter of the tapered outer surface of the outer conductor engager, wherein the compression ring is configured to engage the tapered outer surface of the outer conductor engager and urge the outer conductor engager against the outer conductor when the body is moved axially relative to the outer conductor engager by the coupler to a second axial position.

16. The cable connector of claim 15, wherein the body includes an annular ring portion defining an inward-facing lip at the forward end of the body, a tapered inner surface, and the compression ring.

17. The cable connector of claim 16, wherein the outer conductor engager includes a plurality of resilient fingers configured to be in electrical communication with the outer conductor of the received coaxial cable, each resilient finger having a first outward-facing barb and an outward-facing tapered surface, and wherein the inward-facing lip of the body is configured to engage the first outward-facing barb of each resilient finger when the body is disposed in the first axial position.

18. The cable connector of claim 16, wherein the coupler includes a threaded portion configured to be threadedly engaged with the interface port and to be fastened to the interface port by relative rotation, the interface port being configured to be drawn toward the outer conductor engager by the fastening such that a face surface of the interface port is configured to engage a front face surface of the outer conductor engager.

19. The cable connector of claim 18, wherein, after the interface port engages a front face surface of the outer conductor engager, the interface port is configured to force the outer conductor engager axially relative to the body when further fastened, thereby causing the tapered inner surface of the body to engage the tapered outer surface of the outer conductor engager.

20. The cable connector of claim 16, wherein the body includes a second inward-facing annular lip having a rearward-facing stop surface configured to abutingly receive a forward stop surface along an outer jacket of the received coaxial cable, wherein the outer conductor engager includes a rearward-facing stop surface configured to abutingly receive a forward edge surface of the outer conductor and an insulator of the received coaxial cable, and wherein the forward edge surface of the coaxial cable is configured to be moved rearward with the outer conductor engager relative to the body as the outer conductor engager is moved relative to the body.

21. The cable connector of claim 20, wherein the forward stop surface along the outer jacket of the coaxial cable is configured to move rearward with the outer conductor engager out of abutment with the rearward-facing stop surface of the second inward-facing annular lip of the body, wherein the outer conductor engager includes a second outward-facing barb having a forward-facing surface, the second outward-facing barb being at an opposite axial side of the first outward-facing barb relative to the tapered outer surface of the outer conductor engager, wherein the forward-facing surface of the second outward-facing barb is configured to engage a rearward-facing surface of the inward-facing lip of the body when the coupler is fully tightened against the interface port, and wherein the body is configured to be axially retained by the second barb of the outer conductor engager in a fully installed state of the connector.

* * * * *